US006527679B2

(12) United States Patent
Wang et al.

(10) Patent No.: US 6,527,679 B2
(45) Date of Patent: Mar. 4, 2003

(54) FOLDING MECHANISM OF A MOTORIZED TREADMILL

(76) Inventors: Leao Wang, No. 1, Lane 233, Sec. 2, Charng Long Rd., Taiping (TW), 411; Peter Wu, No. 1, Lane 233, Sec. 2, Charng Long Rd., Taiping (TW), 411

( * ) Notice: Subject to any disclaimer, the term of this patent is extended or adjusted under 35 U.S.C. 154(b) by 137 days.

(21) Appl. No.: 09/757,093

(22) Filed: Jan. 10, 2001

(65) Prior Publication Data

US 2002/0052267 A1 May 2, 2002

Related U.S. Application Data

(63) Continuation-in-part of application No. 09/698,651, filed on Oct. 30, 2000.

(51) Int. Cl.[7] ..... A63B 22/02
(52) U.S. Cl. ..... 482/54; 482/51
(58) Field of Search ..... 482/51, 54

(56) References Cited

U.S. PATENT DOCUMENTS 6,100,076 A * 8/2000 Hurt ..... 482/54
6,135,925 A * 10/2000 Liu ..... 482/54

* cited by examiner

*Primary Examiner*—Glenn E. Richman
(74) *Attorney, Agent, or Firm*—Troxell Law Office PLLC; Kuo-Hsiung Chiu

(57) ABSTRACT

The present invention relates to a folding unit of a motorized treadmill which includes a main body, a deck, a deck transmission assembly and a folding mechanism. Mainly, an auxiliary folding assembly is pivotably connected to the slide shaft, and a movable support fixed at the rear end of the auxiliary folding assembly 50 is able to make a to-and-fro sliding movement on the main body with the slide shaft so that the movable support of the auxiliary folding assembly is permanently situated behind the center of gravity of the deck 20 when the deck folds up.

2 Claims, 3 Drawing Sheets

FOLDING MECHANISM OF A MOTORIZED TREADMILL

The present pending invention is a continuation-in-part of U.S. patent application Ser. No. 09/698,651, filed in Oct. 30, 2000.

BACKGROUND OF THE INVENTION

1. Field of the Invention

The present invention relates to a folding mechanism of a motorized treadmill, and more particularly, to an exercise treadmill that allows the deck to be more stable when folding up.

2. Description of the Prior Art

The U.S. patent application Ser. No. 09/698,651 discloses a treadmill that has a main body, a deck, a belt transmission assembly and a folding mechanism. The treadmill folds up for storage by means that the folding mechanism raises or lowers the deck. However, the treadmill of the previous application easily shakes and is unstable because the center of gravity is just located in front of the fulcrum of moment when it folds up. Therefore, it needs to be improved.

SUMMARY OF THE INVENTION

It is a primary object of the present invention to provide a folding mechanism of a motorized treadmill that created a more stable folding travel.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
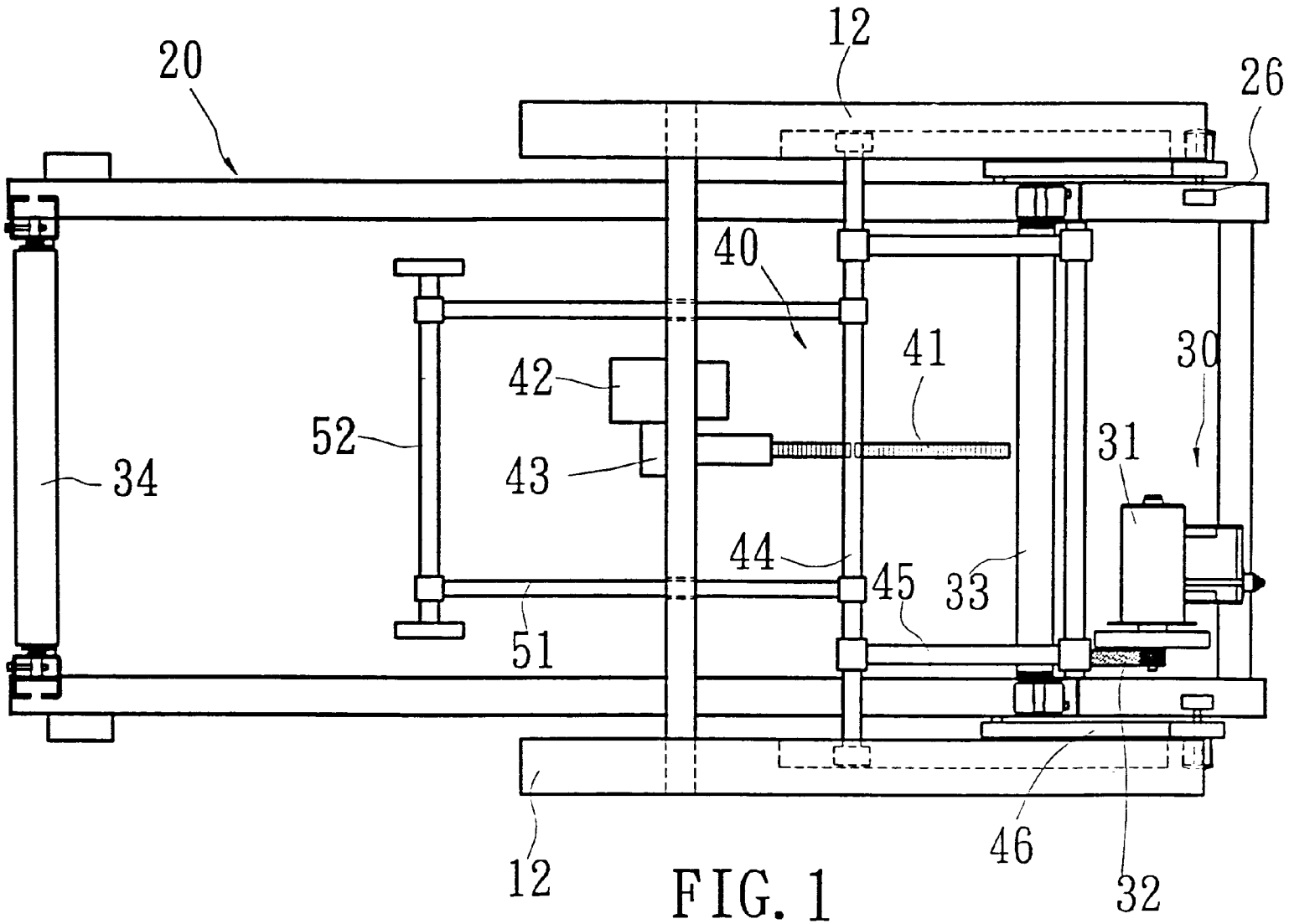
FIG. 1 is a bottom view of the present invention after assembly.
Figure 2:
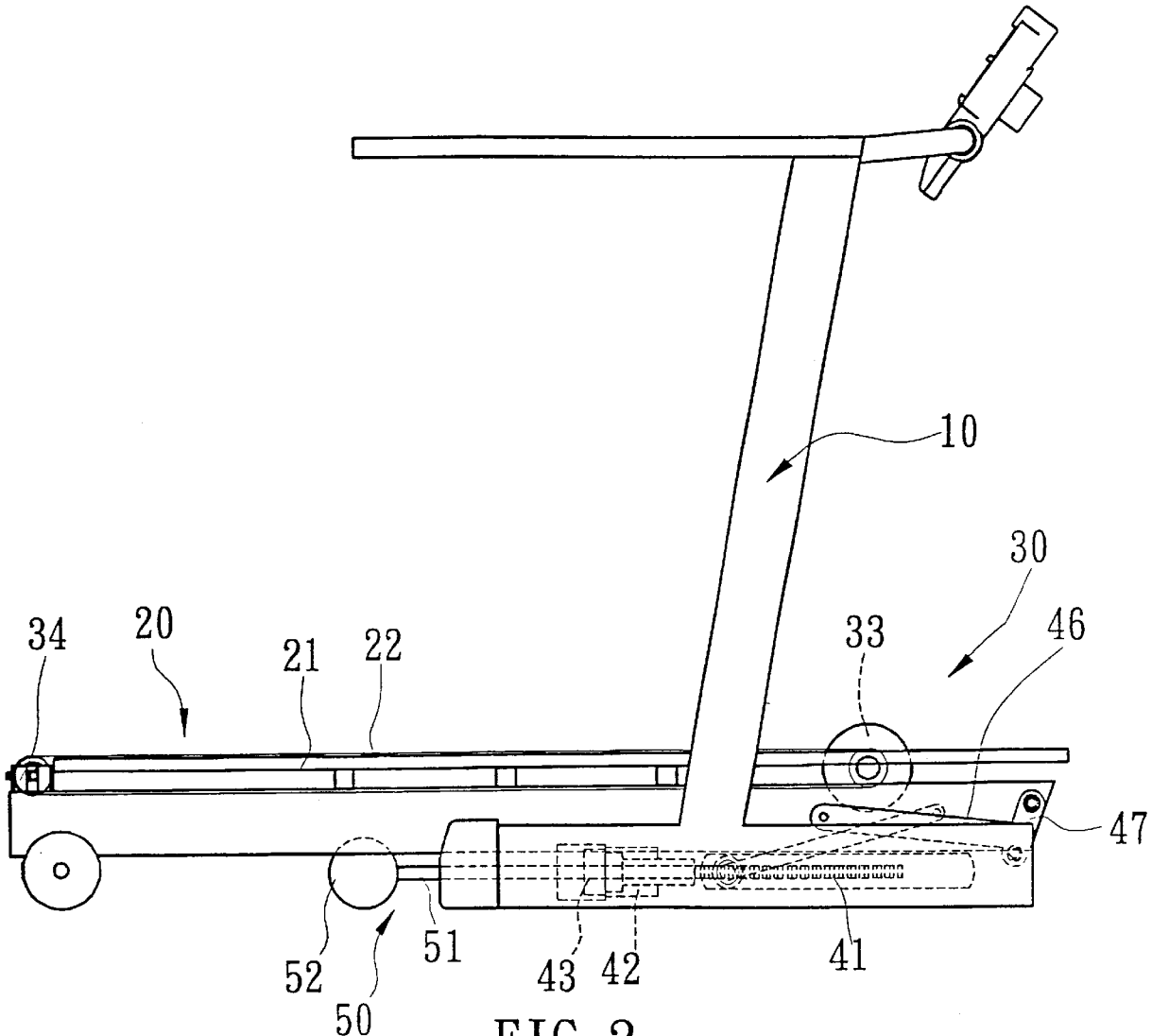
FIG. 2 is a side view of the present invention before folding up.
Figure 3:
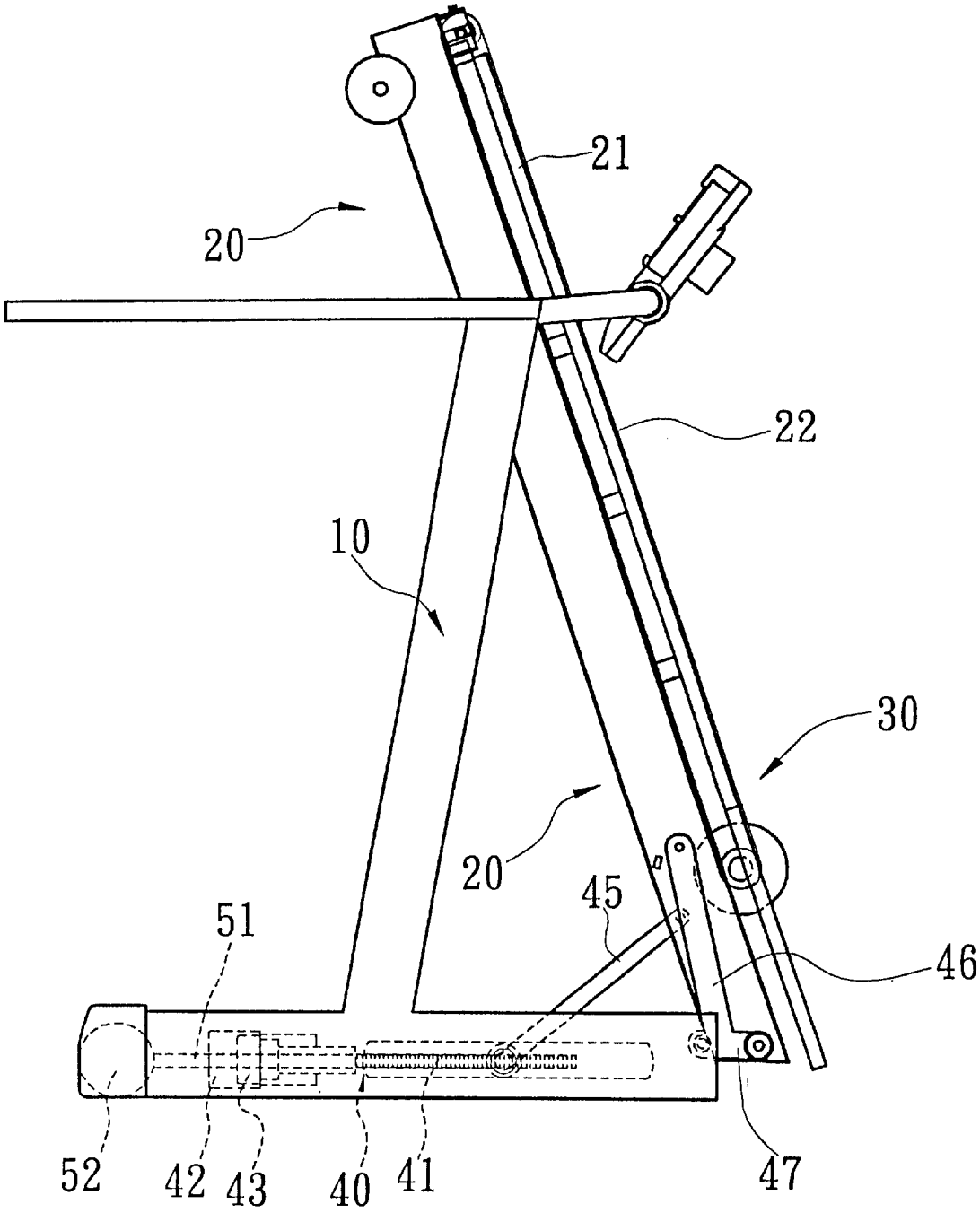
FIG. 3 is a side view of the present invention after folding up.

First of all, referring to FIGS. 1 through 3, the folding mechanism of a motorized treadmill in accordance with the present invention includes a main body 10, a deck 20, a deck transmission assembly 30 and a folding mechanism 40. The deck 20 positioned between two foot bases 12 of the main body 10 comprises a running bed 21 and a running belt 22. The deck transmission assembly 30 arranged at one end of the deck 20 includes a main motor 31, a belt wheel 32 and a primary transmission shaft 33 and a secondary transmission shaft 34. The main motor 31 drives the belt wheel 32 for rotating a running belt 22. The folding mechanism 40 uses a servomotor 42 that drives a transmission spindle 41 to turn by means of a gear box 43, causing a slide shaft 44 to make a to-and-fro sliding movement. The slide shaft 44 includes two lift shafts 45, two folding bars 46 and two movable rods 47. The lift shafts 45 are used to lift the front end of the deck 20 when the slide shaft 44 moves to and fro. Alternatively, the deck 20 is driven to perform a folding action by means that the folding bars 46 and the movable rods 47 are pivotably connected to the main body 10.

Moreover, an auxiliary folding assembly 50 including two parallel connection bars 51 and a movable support 52 is pivotably connected to the slide shaft 44. One end of the connection bars 51 is pivotably connected to the slide shaft 44 while the movable support 52 is fixed at the other end of the connection bars 51 and serves as a component having the sliding feature, allowing the movable support 52 to slide with the slide shaft 44 between the foot bases 12 of the main body 10. When the deck 20 folds up, the movable support 52 of the auxiliary folding assembly 50 is permanently situated behind the center of gravity of the deck 20. Accordingly, the deck 20 folds up more smoothly.

In addition, the relationship between the auxiliary folding assembly 50 and the deck 20 needs to be explained. Before the deck 20 folds up by the folding mechanism 40, the movable support 52 is originally positioned behind the center of gravity of the deck 20. While the deck 20 folds up thereby, the relationship between the position of the center of gravity and the main body 10 is changed with the varied angle. However, the movable support 52 (moment point) is also moved with the slide shaft 44. Accordingly, the movable support 52 is permanently positioned behind the center of gravity of the deck 20. Therefore, the folding mechanism 40 folds up more smoothly and the whole treadmill doesn't shake. Besides, the movable support 52 is just received between the foot bases of the main body 10 after the deck 20 folds up.

Furthermore, two ends of the movable support 52 of the auxiliary folding assembly 50 is also able to be received between the foot bases while the slide shaft 44 slides on the main body 10.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A folding electric exercise treadmill comprising:

a) a main frame having an inverted U-handrail and two opposing foot seats;

b) a deck frame having front and rear end portions, the front end portion interposed between the two foot seats, and including a deck thereon and a running belt mounted around said deck, the deck frame being movable between a use position and a folded position;

c) a belt-driving assembly mounted at one end of said deck frame, including a main motor driving a belt wheel which rotates a drive shaft to move said running belt;

d) an elevating folding unit interposed between the two foot seats, and including: a servomotor driving a gear box which rotates a transmission spindle, said transmission spindle engaging a slide shaft slidably mounted to the foot seats such that said slide shaft undergoes forward and backward movement; two lift shafts pivotally mounted on said slide shaft, and pivotally mounted on said deck frame; two folding bars and two movable rods pivotally mounted between said deck frame and a foot seat of said main frame; and, e) an auxiliary folding assembly including at least one connection bar connected to and movable with the slide shaft and extending toward the rear end portion of the deck frame, and a movable support bar mounted to the at least one connection bar, the movable support bar being an auxiliary support for the main frame as the rear end portion of the deck frame is moved between the use position and the folded position.

2. The folding electric exercise treadmill of claim 1 wherein the movable support bar is located between the two opposing foot seats when the deck frame is in the folded position.

* * * * *